US006196199B1

(12) United States Patent
Jiang

(10) Patent No.: US 6,196,199 B1
(45) Date of Patent: Mar. 6, 2001

(54) FUEL INJECTOR ASSEMBLY HAVING AN IMPROVED SOLENOID OPERATED CHECK VALVE

(75) Inventor: He Jiang, Canton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/473,044

(22) Filed: Dec. 28, 1999

(51) Int. Cl.[7] ..... F02M 37/04
(52) U.S. Cl. ..... 123/506; 123/446; 239/90
(58) Field of Search ..... 123/446, 467, 123/506, 458; 239/88, 89, 90, 91

(56) References Cited

U.S. PATENT DOCUMENTS

| | | | | |
|---|---|---|---|---|
| 4,402,456 | * | 9/1983 | Schneider | 239/90 |
| 5,443,047 | * | 8/1995 | Ishiwata et al. | 123/446 |
| 5,463,996 | * | 11/1995 | Maley | 123/446 |
| 5,535,723 | * | 7/1996 | Gibson et al. | 123/446 |
| 5,628,293 | * | 5/1997 | Gibson | 123/446 |
| 5,743,228 | * | 4/1998 | Shorey et al. | 123/506 |
| 5,819,704 | * | 10/1998 | Tarr et al. | 123/467 |
| 5,915,361 | * | 6/1999 | Heinz et al. | 123/458 |
| 5,941,215 | * | 8/1999 | Augustin | 123/458 |

* cited by examiner

*Primary Examiner*—Thomas N. Moulis
(74) *Attorney, Agent, or Firm*—Bill C Panagos

(57) ABSTRACT

A fuel injector assembly for an internal combustion engine including an injector body in fluid communication with a source of fuel and a nozzle assembly through which fuel is dispersed from the fuel injector assembly during an injection event. A high pressure fuel delivery system provides high pressure fuel to the nozzle assembly. The injector body defines a low pressure fuel spill gallery in which unused fuel is collected from the high pressure fuel delivery system. The high pressure fuel delivery system includes a cylindrical bore, a plunger supported for reciprocation within the cylindrical bore, a pump chamber defined by the plunger and the cylindrical bore, and a high pressure fuel passage extending through the injector body from the pump chamber to the nozzle assembly for dispersing fuel at high pressure from the injector assembly. A solenoid operated check valve is located between the pump chamber and the nozzle assembly and between the low pressure fuel spill gallery and the high pressure fuel passage. The check valve is operable to control the pressure in the fuel delivery system by alternatingly reducing the pressure in the fuel system or increasing the pressure in the fuel delivery system by opening and closing same.

14 Claims, 4 Drawing Sheets

FUEL INJECTOR ASSEMBLY HAVING AN IMPROVED SOLENOID OPERATED CHECK VALVE

BACKGROUND OF THE INVENTION

1. Field of the Invention

The present invention relates, generally, to fuel injector assemblies for internal combustion engines. More specifically, the present invention relates to such a fuel injector having an improved solenoid operated check valve located below the pump chamber and above the nozzle assembly within the injector body.

2. Description of the Related Art

Fuel injector assemblies are employed in internal combustion engines for delivering a predetermined, metered mixture of fuel and air to the combustion chamber at preselected intervals. Fuel injectors commonly employed in the related art typically include a cylindrical bore formed in the main injector body. A plunger is reciprocated within the cylindrical bore to increase the pressure of the fuel. A solenoid actuated control valve is mounted in an injector side body and communicates with a source of fuel. A high pressure fuel passage extends between the solenoid actuated control valve and the cylinder bore. Fuel at relatively low pressure is supplied to the control valve which then meters the delivery of the fuel at predetermined intervals through a fuel passage to the cylindrical bore. Fuel at very high pressures is delivered to a fuel nozzle assembly and ultimately dispersed from the injector.

In the case of compression ignition or diesel engines, the fuel/air mixture is delivered at relatively high pressures. Presently, conventional injectors are delivering this mixture at pressures as high as 32,000 psi. These are fairly high pressures and have required considerable engineering attention to ensure the structural integrity of the injector, good sealing properties and the effective atomization of the fuel within the combustion chamber. In essence, the modern diesel engine must provide substantial fuel economy advantages while meeting ever more stringent emission regulations. However, increasing demands for greater fuel economy, cleaner burning, fewer emissions and $NO_x$ control have placed, and will continue to place, even higher demands on the engine's fuel delivery system, including increasing the fuel pressure within the injector.

In part to meet the challenges discussed above, electronic engine control modules have been employed to control the beginning and end of the fuel injection event, injection timing and fuel quantity, to improve fuel economy and meet emission requirements.

However, problems still remain. For example, fuel injectors of the type commonly known in the art and briefly described above often include relatively long, internal fuel flow passages. These passages include those extending from the control valve to the pump chamber, passages extending from the pump chamber to the nozzle assembly and passages extending between the high pressure fuel passage and any low pressure fuel return passages. During an injection event, it is not uncommon for pressure waves to develop within these passages. The dynamics of such pressure waves can have a negative effect on fuel injection. In addition, injectors which include shared passages for both fuel feed in and spilling are particularly susceptible to this problem.

Furthermore, it is not uncommon for the solenoid actuated control valve used in the injectors of the related art to experience mechanical bouncing as the valve member is cycled between its open and closed positions. This causes imprecise injection control at the beginning and end of the injection event and is undesirable. Thus, there is an ongoing need in the art for better control over these injection parameters during the span of the injection event in a cost effective manner.

SUMMARY OF THE INVENTION

The present invention overcomes the disadvantages in the related art in a fuel injector assembly for an internal combustion engine having an injector body in fluid communication with a source of fuel. The injector assembly further includes a nozzle assembly through which fuel is dispersed from the fuel injector assembly during an injection event. A high pressure fuel delivery system provides high pressure fuel to the nozzle assembly. The injector body also defines a low pressure fuel spill gallery in which unused fuel is collected from the fuel delivery system. The high pressure fuel delivery system includes a cylindrical bore and a plunger supported for reciprocation within the cylindrical bore. A pump chamber is defined by the plunger and the cylindrical bore. A high pressure fuel passage extends through the injector body from the pump chamber to the nozzle assembly for dispersing fuel at high pressures from the injector assembly.

In addition, the injector assembly includes a solenoid operated check valve which is located between the pump chamber and the nozzle assembly and between the low pressure fuel spill gallery and the high pressure fuel passage. The check valve is operable to control the pressure in the high pressure fuel delivery system. More specifically, the check valve is movable between an open position wherein fluid communication is established between the high pressure fuel passage and the low pressure spill gallery thereby reducing the pressure in the fuel delivery system, to a closed position which interrupts fluid communication between the high pressure fuel passage and the low pressure spill gallery thereby increasing the pressure in the fuel delivery system and facilitating the delivery of fuel at high pressure from the pump chamber to the nozzle assembly.

The fuel injector assembly is therefore compact having the control valve located very close to the nozzle assembly. The injector assembly employs very short flow passages extending from the high pressure fuel passage to the control valve as well as from the control valve to the low pressure fuel spill gallery. The pump chamber is also formed at a relatively low place along the vertical length of the injector assembly. Furthermore, the fuel injector assembly requires no changes to mount it to a cylinder head.

Thus, one advantage of the fuel injector of the present invention is that it minimizes the effects of pressure wave dynamics on the control valve and nozzle assemblies by using very short flow passages and locating the control valve between the pumping chamber and the nozzle assembly at a position low on the injector assembly.

Another advantage of the present invention is that it minimizes the effects of fuel feeding and spilling pressures on the injector performance by employing separate fuel feed in and fuel return passages.

Another advantage of the present invention is that it provides for more accurate control of the solenoid actuated check valve. This feature results in better control of the injection event and provides for better pilot injection capability.

Other objects, features and advantages of the present invention will be readily appreciated as the same becomes better understood after reading the subsequent description taken in connection with the accompanying drawings.

DETAILED DESCRIPTION OF THE PREFERRED EMBODIMENT(S)

Figure 1:
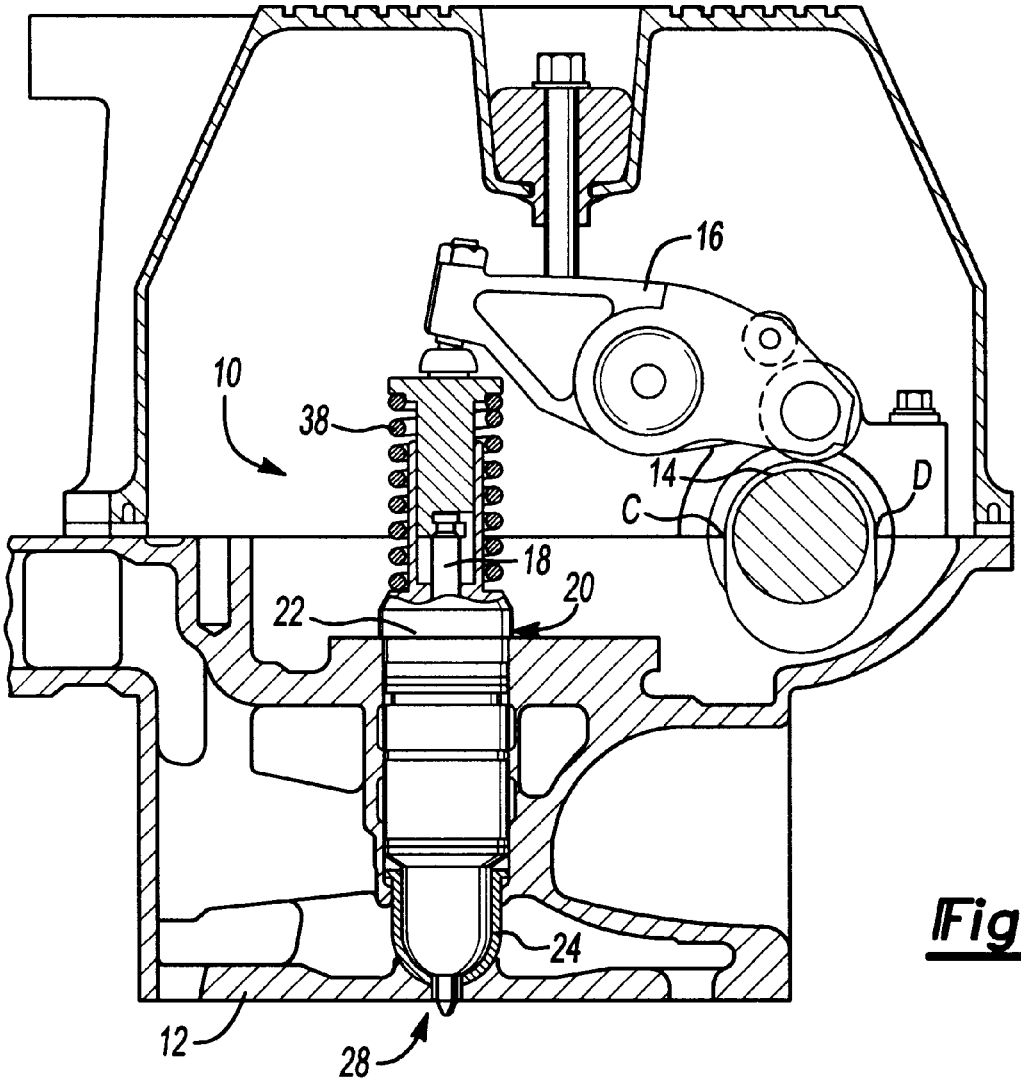
FIG. 1 is a cross-sectional side view of a fuel injector supported in a cylinder head and actuated by cam driven rocker arms.

Referring now to the figures, where like numerals are used to designate like structure throughout the drawings, a fuel injector assembly for an internal combustion engine is generally indicated at 10 in FIG. 1. The injector assembly 10 is shown in a typical environment supported by a cylinder head 12 and adapted to inject fuel into a cylinder of an internal combustion engine. The fuel is combusted to generate power to rotate a crankshaft. A cam 14 is rotated to drive a rocker arm 16, which in turn, actuates a plunger 18 supported for reciprocation by the injector assembly 10. Alternatively, an engine driven cam may be employed to actuate the plunger 18 directly as is commonly known in the art. Movement of the plunger 18 acts to increase the fuel pressure within the injector assembly 10. Fuel is ultimately injected by the assembly 10 into a cylinder at high pressure as will be described in greater detail below.

Figure 2:
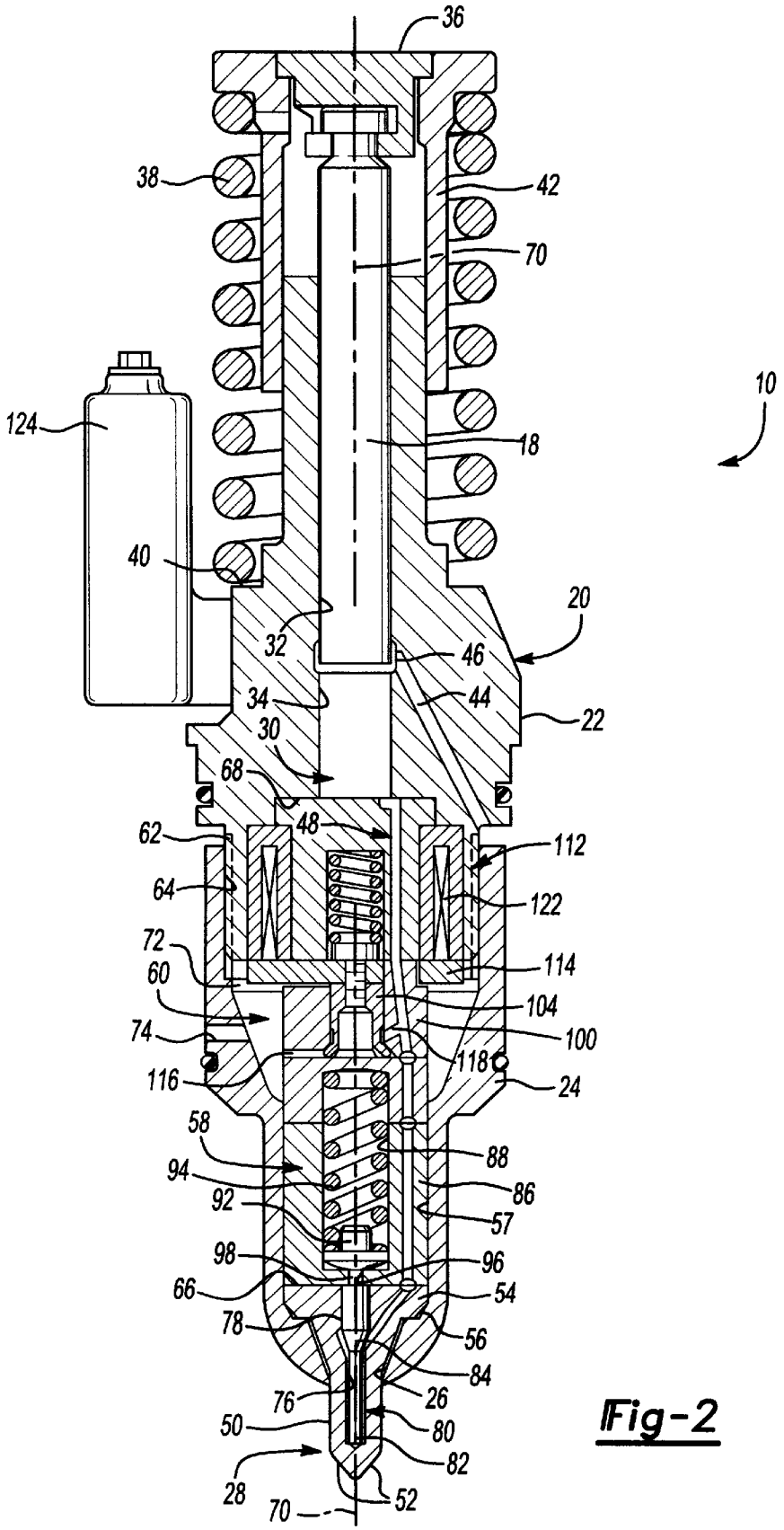
FIG. 2 is a cross-sectional side view of the fuel injector assembly of the present invention.

Referring now to FIG. 2, a fuel injector assembly 10 according to the present invention is shown in cross-section and includes a vertically extending injector body 20 in fluid communication with a source of fuel. The injector body 20 includes a bushing 22 and a nut 24 threaded to the lower end of the bushing 22 and which forms an extension thereof. The nut 24 has an opening 26 at its lower end through which extends the lower end of a nozzle assembly, generally indicated at 28. Fuel is dispersed from the nozzle assembly 28 during an injection event as will be described in greater detail below.

The injector assembly 10 also includes a high pressure fuel delivery system, generally indicated at 30, which serves to provide fuel at high pressure to the nozzle assembly 28. Thus, the high pressure fuel delivery system 30 includes a cylindrical bore 32 formed in the bushing 22. The plunger 18 is slidably received by the cylindrical bore 32. Together, the plunger 18 and cylindrical bore 32 define a pump chamber 34. The plunger 18 extends out one end of the bushing 22 and is topped by a cam follower 36. A return spring 38 supported between a ledge 40 formed on the bushing 22 and a plunger spring retainer 42 serve to bias the plunger 18 to its fully extended position. A stop pin (not shown) extends through an upper portion ofthe injector body 20 into an axial groove formed in either the plunger 18 or spring retainer 42 to limit upward travel of the plunger 18 induced under the bias of the return spring 38.

Low pressure fuel is supplied to the assembly 10 from a fuel rail or the like through a fuel feed passage 44 formed in the bushing 22. The fuel feed passage 44 communicates with the pump chamber 34 via an inlet port 46. On the other hand, the high pressure fuel delivery system 30 further includes a high pressure fuel passage, generally indicated at 48, which extends through the injector body 20 from the pump chamber 34 to the nozzle assembly 28.

The nozzle assembly 28 includes a spray tip 50 having at least one, but preferably a plurality of, apertures 52 through which fluid is dispersed from the assembly 28. The spray tip 50 is enlarged at its upper end to provide a shoulder 54 which seats on an internal shoulder 56 provided by the through counter-bore 57 in the nut 24. Between the spray tip 50 and the lower end of the bushing 22, there is positioned above the nozzle assembly 28, in sequence starting from the spray tip 50, a biasing member, generally indicated at 58, and a solenoid operated check valve generally indicated at 60. As illustrated in these figures, these elements are formed as separate parts for ease of manufacturing and assembly. The nut 24 is provided with internal threads 62 for mating engagement with the internal threads 64 at the lower end of the injector body 20. The threaded connection of the nut 24 to the injector body 20 holds the spray tip 50, biasing member 58, and solenoid operated check valve 60 clamped and stacked end to end between the upper face 66 of the spray tip 50 and the bottom face 68 of the injector body 20. All ofthese above-described elements have lapped mating surfaces whereby they are held in pressure sealed relation to each other.

The injector body 20 has a longitudinal axis 70 which defines the centerline thereof. The plunger 18, check valve 60 and nozzle assembly 28 are each disposed axially along this centerline. In addition, the nut 24 defines a low pressure fuel spill gallery 72 in which unused fuel is collected from the fuel delivery system 30. Fuel exits the injector body 20 via fuel return port 74 formed in the nut 24 adjacent the spill gallery 72. The spill gallery 72 and the high pressure fuel passage 48 are laterally spaced from and specifically located on opposite sides of the centerline within the injector body 20.

The nozzle assembly 28 includes a nozzle bore 76 formed in the spring tip 50 along the centerline of the injector body 20. The bore 76 is in fluid communication with the high pressure fuel passage 48 and defines an injection cavity 78. The nozzle assembly 28 also includes a needle valve, generally indicated at 80 which is movably supported within the nozzle bore 76 in response to fuel pressure between a closed position, wherein no fuel is dispersed from the nozzle assembly 28 and an open position wherein fuel is dispersed from the nozzle tip 50 through the aperture 52 when the pressure in the nozzle bore exceeds a predetermined needle opening pressure. Accordingly, the needle valve 80 has a tip portion 82 and a valve portion 84 which is complementarily received within the injection cavity 78. The tip portion 82 is adapted to close the apertures 52 when the pressure in the fuel delivery system 30 is below the needle closing pressure. On the other hand, the needle valve 80 is responsive to the pressure acting on the valve portion 84 within the injection cavity 78 to move to its open position, thereby dispersing fuel from the injector assembly 10 through the apertures 52. The biasing member 58 biases the needle valve 80 to its closed position with a predetermined force such that the needle valve 80 moves to its open position only after the pressure from the fuel delivery system 30 acting within the injector cavity 78 has reached a needle opening pressure.

The biasing member 58 includes a spring cage 86 supported at one end in abutting contact with the upper face 68 of the spray tip 50. The spring cage 86 has a spring chamber 88 formed therein. Within the spring chamber 88 there is a lower retainer 92. A coiled spring 94 is housed within the chamber 88 and acts to bias the lower retainer with a predetermined force. The spring cage 86 includes a lower aperture 96 corresponding to the lower retainer 92 and extending between the spring chamber 88 and the nozzle bore 76. The needle valve 80 also includes a head 98 which is disposed opposite the tip portion 82. The head 98 is received through the lower aperture 96 and is engaged by the lower retainer 92. Thus, the lower retainer 92 translates the predetermine force to the needle valve 80 to bias it to its closed position.

Figure 3:
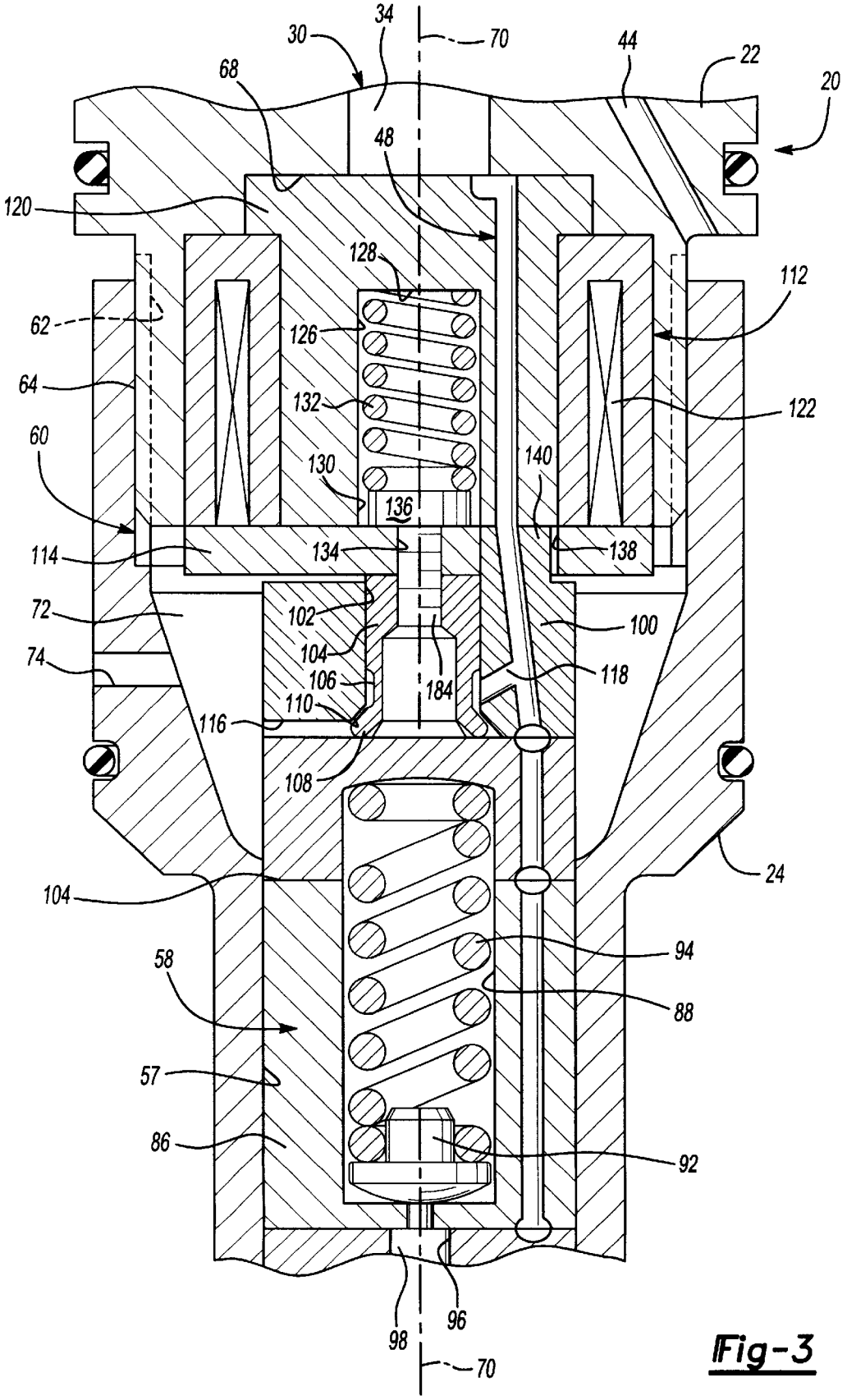
FIG. 3 is an enlarged, partial cross-sectional side view of the fuel injector illustrating the solenoid operated check valve of the present invention.

As shown in FIGS. 2 and 3, the solenoid operated check valve 60 is located between the pump chamber 34 and the nozzle assembly 28 and between the low pressure fuel spill gallery 72 and the high pressure fuel passage 48. More specifically, the check valve 60 is directly beneath the pump chamber and immediately above biasing member 58 and the nozzle assembly 28. The check valve 60 is operable to control the pressure in the fuel delivery system 30. To this end, he check valve 60 is movable between an open position, wherein fluid communication is established between the high pressure fuel passage 48 and the low pressure spill gallery 72 thereby reducing the pressure in the fuel delivery system 30 to a closed position interrupting communication between the high pressure fuel passage 48 and the low pressure spill gallery 72 thereby increasing the pressure in the fuel delivery system 30. Closure of the check valve 60 and increasing the pressure in the fuel delivery system 30 facilitates the delivery of fuel at high pressure from the pump chamber 34 to the nozzle assembly 28.

As best shown in FIG. 3, the check valve 60 includes a valve housing 100 having a valve bore 102 and a valve member 104 movably supported therein. The valve member 104 has an area 106 of reduced diameter which merges into a valve head 108. The valve bore 102 defines a valve seat 110. The valve head 108 is adapted for sealing engagement with the valve seat 110 when the check valve 60 is in its closed position.

A solenoid assembly, generally indicated at 112, is mounted adjacent the housing 100. An armature 114 electromagnetically interconnects the valve member 104 and the solenoid assembly 112 and acts to move the valve member 104 between its open and closed positions. A conduit 116 extends within the housing 100 between the valve bore 102 and the fuel spill gallery 72. In addition, a connecting port 118 extends within the housing 100 between the valve bore 112 and the high pressure fuel passage 48. The conduit 116 is very short and straight but extends substantially perpendicularly to the longitudinal axis 70 of the injection body 20. Similarly, the connecting port 118 is also very short and straight but extends at an angle relative to the longitudinal axis 70. Due in part to their short length and relatively straight path as well as their angular disposition relative to their longitudinal axis 70, the conduit 116 and connecting port 118 tend to resist the development of pressure waves and the associated pressure wave dynamics as will be discussed in greater detail below.

The solenoid assembly 112 includes a pole piece 120 and a coil 122 wound about the pole piece 120. The coil 122 is electrically connected to a terminal 124 (shown in FIG. 2) which, in turn, is connected to a source of electrical power via a fuel injection electronic engine control module. The pole piece 120 includes a bore 126 having a blind end 128 and an open end 130 which faces the armature 114. A coiled spring 132 is captured within the bore 126 and between the blind end 128 and the armature 114 to bias the valve member 104 to its normally opened position. The armature 114 includes an opening 134 which is aligned with the bore 126 in the pole piece 120. A fastener 136 extends through the opening 134 and interconnects the armature 114 with the valve member 104. The valve member is moved upwardly as viewed in the figures and the check valve 60 is closed when the coil 122 is energized to generate a magnetic flux which acts on the armature 114. In this disposition, the valve head 108 is seated with the valve seat 110.

In the embodiment illustrated in FIGS. 2 and 3, the armature 114 includes a channel 138 extending therethrough. The valve housing 100 includes a stepped portion 140 loosely received in the channel 138 so as to accommodate movement of the armature 114 but adapted for sealed abutting contact with the pole piece 120. Thus, the high pressure fuel passage 48 may extend through the pole piece 120 and the valve housing 100 through the stepped portion 140.

Operation

In operation, low pressure fuel is supplied to the assembly 10 from a fuel rail or the like through the fuel feed passage 44. Fuel enters the pump chamber 34 via the inlet port 36 when the plunger 18 is at its fully extended or rest position under the biasing influence of the return spring 3 8 as shown in FIG. 2. As illustrated in FIG. 1, the cam 14 is designed so that the duration of its total lift section (between points C and D) is about 180° of turning angle. The plunger 18 is driven downward by the cam lobe via the rocker arm 16 from its rest position to its maximum lift (or lowest position) and then back to the rest position in the first half turn of cam rotation. The plunger 18 stays at its top, rest position for the remaining half turn of cam rotation.

When the cam 14 rotates such that the lobe actuates the rocker arm 16, the plunger 18 is driven downward and the inlet port 36 is closed by the plunger 18. Downward movement ofthe plunger 18 increases the pressure in the fuel delivery system 30 to a maximum at maximum plunger lift.

The solenoid operated check valve 60 is normally held in its open position with the valve member 104 unseated under the biasing influence of the coiled spring 132. In this disposition, the fuel delivery system 30 is in fluid communication with the low pressure fuel spill gallery 72 via the connecting port 118 and conduit 116. More specifically, when the check valve 60 is open, pressurized fuel may flow from the high pressure fuel passage 48 through the connecting port 118 into the valve bore 102. The head 108 of the valve member 104 is disposed spaced from the valve seat 110 formed on the valve bore 102. Thus, the pressurized fuel will flow past the valve member 104 through the conduit 116 and into the low pressure spill gallery 72. Accordingly, the fuel delivery system 30 is vented to the low pressure side of the injector assembly and high injection pressures cannot be developed in the injector.

However, the operation of the check valve 60 is controlled by an engine control module or some other control device. More specifically, during the downward stroke of the plunger 18, the solenoid assembly 112 may be powered to generate an electromagnetic force. The force attracts the armature 114 toward the solenoid assembly 112 (upwardly as viewed in the figures) which, in turn, moves the valve member 104 against the biasing force of the spring 132 to its closed position. In this disposition, the head 108 of the valve member 104 is sealed against the valve seat 110 thereby interrupting communication between the fuel delivery system 30 and the fuel spill gallery 72 via the check valve 60. The fuel delivery system 30 is then pressurized by the pumping action of the plunger 18 during its downward stroke.

The nozzle assembly 28 is normally closed by the biasing force of the coiled spring 94 acting through the head 98 of the needle valve 80. The needle valve 80 is responsive to system pressure acting in the injection cavity 78 against the valve portion 84 to move the needle valve 80 to its open position. When the check valve 60 is closed, system pressure rises until the needle valve 80 is opened. The fuel injection event then begins.

At the end of the injection event, the solenoid assembly 112 is de-energized, the valve member 104 is biased to its open position under the influence of the coiled spring 132 and the high pressure fuel delivery system 30 is completely vented to the low pressure fuel spill gallery 72. The needle valve 80 reseats under the influence of the coiled spring 94 and the process is repeated.

Due in part to their short length and relatively straight path, the conduit 116 and connecting port 118 tend to resist development of pressure waves and the associated pressure wave dynamic which can be generated within the injector body 20. This feature therefore facilitates the smooth operation of the check valve as well as the operation of the nozzle assembly 28.

Where a high velocity injection cam is used or the diameter of the plunger is specified so as to generate high injection pressures at lower engine speed or load, the system pressures generated at high engine speed or high load may test the integrity of the injector, cause failure or lead to premature wear. However, the check valve 60 of the present invention may also be employed to limit such high injection pressures by moving to its open position when such pressures have reached a predetermined level. Similarly, the check valve 60 may also be employed to induce a short burst of fuel or "pilot injection" into the combustion chamber prior to the main injection event by moving to its closed position causing pressure to build within the injector body and the nozzle assembly to momentarily open. The check valve 60 is then opened slightly to reduce system pressure and cause the nozzle to close. The check valve 60 is thereafter closed again to allow system pressure to build, once again, and complete the injection event.

Figure 4:
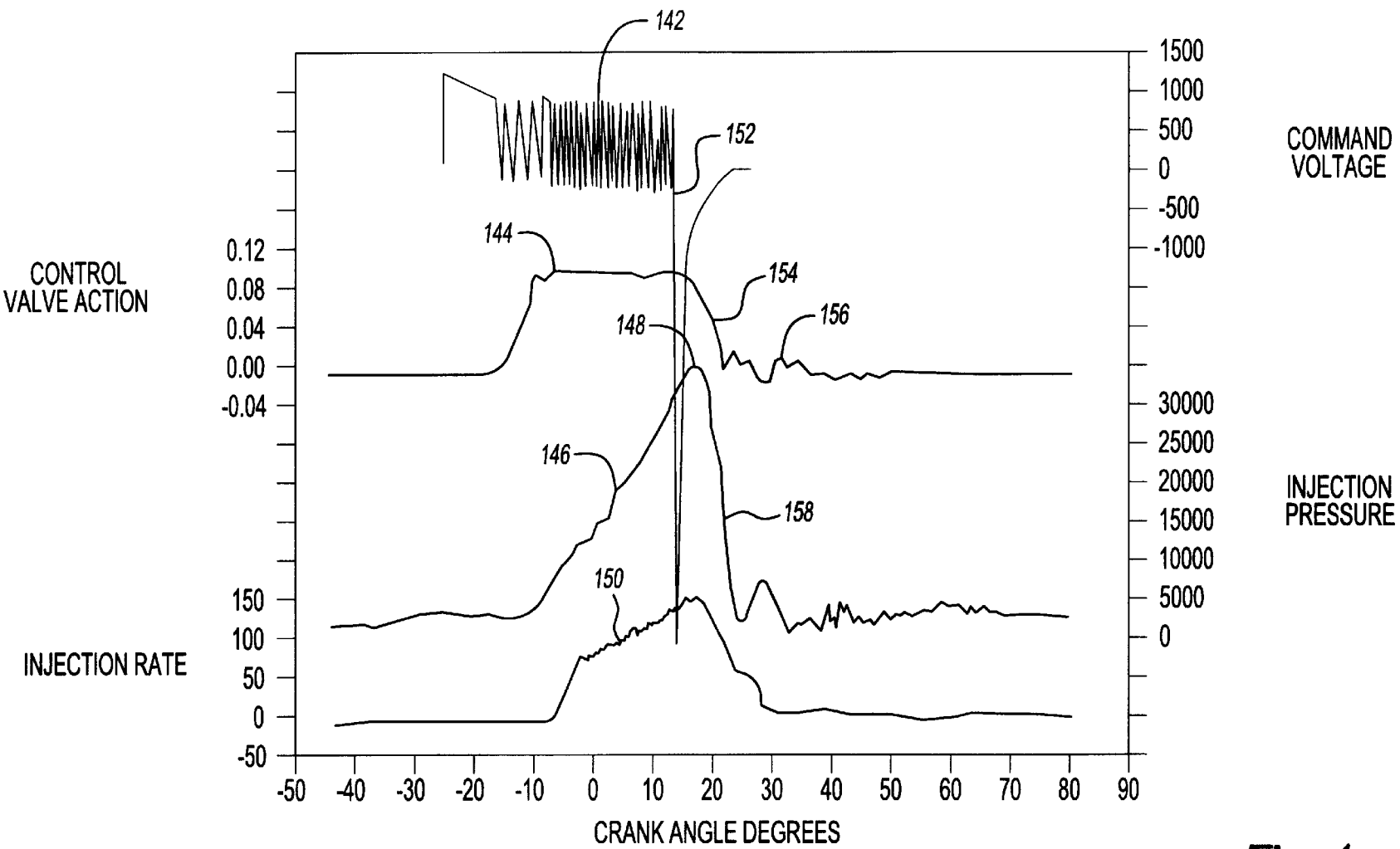
FIG. 4 is a graph illustrating command voltage, control valve action, injection pressure, and injection rate over the movement of the crank angle in degrees for a fuel injector of the present invention.

The operation of the solenoid actuated check valve 60 of the present invention is illustrated graphically in FIG. 4 where the command voltage, control valve action, injection pressure and injection rate over the movement of the crank angle in degrees for a fuel injector is illustrated. There, the command voltage 142 is supplied to the solenoid coil 132 which causes the main valve member 104 to move to its closed position as indicated at 144. The injection pressure begins to rise smoothly as indicated at 146 and results in a substantially triangular shape having a maximum pressure indicated at 148. The injection rate also increases and forms a triangular shape as indicated at 150. The check valve 60 is held shut until command voltage is interrupted as indicated at 152. The valve member 104 immediately begins to move to its open position as indicated at 154 with minimal bounce as shown at 156. The maximum pressure 148 is achieved approximately 1 to 2 crank angle degrees after the termination of the control voltage and then drops off sharply thereafter as shown at 158. FIG. 4 further illustrates very little or no effect to the check valve operation due to pressure wave dynamics. Furthermore, FIG. 4 graphically illustrates an accurate control of the solenoid actuated check valve 60. This results in better control of the injection event and provides for better pilot injection capability.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. A fuel injector assembly for an internal combustion engine comprising:

an injector body in fluid communication with a source of fuel;

a nozzle assembly through which fuel is dispersed from said fuel injector assembly during an injection event;

a high pressure fuel delivery system providing high pressure fuel to said nozzle assembly;

said injector body defining a low pressure fuel spill gallery in which unused fuel is collected from said high pressure fuel delivery system;

said high pressure fuel delivery system including a cylindrical bore, a plunger supported for reciprocation within said cylindrical bore, a pump chamber defined by said plunger and said cylindrical bore, and a high pressure fuel passage extending through said injector body from said pump chamber to said nozzle assembly for dispersing fuel at high pressure from said injector assembly;

a solenoid operated check valve disposed between said pump chamber and said nozzle assembly and between said low pressure fuel spill gallery and said high pressure fuel passage, said check valve being operable to control the pressure in said fuel delivery system by being movable between an open position wherein fluid communication is established between said high pressure fuel passage and said low pressure spill gallery thereby reducing the pressure in said fuel delivery system, to a closed position interrupting fluid communication between said high pressure fuel passage and said low pressure spill gallery thereby increasing the pressure in said fuel delivery system and facilitating the delivery of fuel at high pressure from said pump chamber to said nozzle assembly.

2. An assembly as set forth in claim 1 wherein said injector body has a longitudinal axis which defines the centerline thereof, said plunger, said check valve and said nozzle assembly each disposed axially along said centerline, said spill gallery and said high pressure fuel passage disposed on opposite sides of said centerline in said injector body.

3. An assembly as set forth in claim 1 wherein said check valve includes a valve housing having a valve bore, a valve member movably supported within said valve bore, a solenoid assembly adjacent said housing and an armature electromagnetically interconnecting said valve member and said solenoid and for moving said valve member between said open and closed positions.

4. An assembly as set forth in claim 3 wherein a conduit extends between said valve bore and said fuel spill gallery in said housing and a connecting port extends between said valve bore and said high pressure fuel passage in said housing.

5. An assembly as set forth in claim 3 wherein said solenoid assembly includes a pole piece and a coil wound about said pole piece, said pole piece including a bore having a blind end and an open end which faces said armature, a coiled spring is disposed within said bore and between said blind end and said armature to bias said valve member to its open position.

6. An assembly as set forth in claim 5 wherein said armature includes an opening aligned with said bore in said pole piece, a fastener extends through said opening and interconnects said armature and said valve member.

7. An assembly as set forth in claim 6 wherein said armature includes a channel extending therethrough, said valve housing including a step portion loosely received in said channel so as to accommodate movement of said armature and adapted for sealed, abutting contact with said pole piece.

8. An assembly as set forth in claim 7 wherein said a portion of said high pressure fuel passage extends through said pole piece and said valve housing through said stepped portion.

9. An assembly as set forth in claim 1 wherein said fuel nozzle assembly includes a nozzle tip having at least one aperture through which fluid is dispensed from said assembly, a nozzle bore in fluid communication with said fuel delivery system and a needle valve movably supported within said nozzle bore in response to fuel pressure between a closed position, wherein no fuel is dispersed from said nozzle assembly and an open position wherein fuel is dispersed from said nozzle tip through said at least one aperture when pressure in said nozzle bore exceeds a predetermined needle opening pressure.

10. An assembly as set forth in claim 9 wherein said nozzle bore defines an injection cavity which is in fluid communication with said fuel delivery system, said needle valve including a tip portion which is adapted to close said at least one aperture in said nozzle tip when the pressure in said fuel delivery system is below said needle closing pressure and a valve portion complementarily received within said injection cavity, said needle valve responsive to pressure acting on said valve portion to move to its open position when said fuel pressure exceeds said needle opening pressure.

11. An assembly as set forth in claim 9 further including a biasing member biasing said needle valve to its closed position with a predetermined force such that said needle valve moves to its open position only after the pressure in said fuel delivery system has reached said needle opening pressure.

12. An assembly as set forth in claim 11 wherein said biasing member includes a spring cage having a spring chamber formed therein, a lower retainer and a coiled spring acting on said lower spring retainer so as to bias said retainer with a predetermined force.

13. An assembly as set forth in claim 12 wherein said lower spring retainer translates said predetermined force to said needle valve to bias said needle valve to its closed position.

14. An assembly as set forth in claim 12 wherein said spring cage includes a lower aperture corresponding to said lower retainer and extending between said spring chamber and said nozzle bore, said needle valve including a head disposed opposite said tip portion, said head received through said lower aperture and engaged by said lower retainer, said predetermined force acting on said needle valve through said head.

* * * * *

UNITED STATES PATENT AND TRADEMARK OFFICE

CERTIFICATE OF CORRECTION

PATENT NO. : 6,196,199 B1
DATED : March 6, 2001
INVENTOR(S) : He Jiang

It is certified that error appears in the above-identified patent and that said Letters Patent is hereby corrected as shown below:

Column 1,
Line 5, after "BACKGROUND OF THE INVENTION", insert -- This invention was made with Government support under DE-FC05-97 OR22581 awarded by the United States Department of Energy. The Government has certain rights in this invention. --

Signed and Sealed this

Eleventh Day of September, 2001

*Attest:*

Nicholas P. Godici

*Attesting Officer*

NICHOLAS P. GODICI
*Acting Director of the United States Patent and Trademark Office*